US005488466A

United States Patent [19]

Abreu

[11] Patent Number: 5,488,466

[45] Date of Patent: Jan. 30, 1996

[54] LIQUID DEVELOPMENT SYSTEM

[75] Inventor: Christian O. Abreu, Rochester, N.Y.

[73] Assignee: Xerox Corporation, Stamford, Conn.

[21] Appl. No.: 287,556

[22] Filed: Aug. 8, 1994

[51] Int. Cl.[6] ..... G03G 15/10

[52] U.S. Cl. ..... 355/256; 118/661; 355/259

[58] Field of Search ..... 355/256, 259, 355/212, 271, 277, 279; 118/661; 430/117–119

[56] References Cited

U.S. PATENT DOCUMENTS

| | | | |
|---|---|---|---|
| 3,804,062 | 4/1974 | Fukushima et al. | 118/637 |
| 4,021,586 | 5/1977 | Matkan | 118/661 X |
| 4,076,405 | 2/1978 | Silverberg | 355/256 |
| 4,089,683 | 5/1978 | Knieser | 430/125 |
| 4,286,039 | 8/1981 | Landa et al. | 430/119 |
| 4,364,661 | 12/1982 | Landa | 355/274 |
| 4,504,138 | 3/1985 | Kuehnle et al. | 118/661 X |
| 4,566,781 | 1/1986 | Kuehnle | 355/256 |
| 4,686,936 | 8/1987 | Chow | 118/661 |
| 4,843,422 | 6/1989 | Mampaey et al. | 250/326 |
| 5,291,251 | 3/1994 | Storlie et al. | 355/271 |

*Primary Examiner*—A. T. Grimley
*Assistant Examiner*—Thu A. Dang
*Attorney, Agent, or Firm*—H. Fleischer; J. E. Beck; R. Zibelli

[57] ABSTRACT

An electrophotographic printing machine in which an electrostatic latent image recorded on a photoconductive member is developed with a liquid developer material. The liquid developer material is advanced by a substantially smooth donor roll from a supply to the latent image at a development zone. The liquid developer material on the donor roll is maintained at a thickness ranging from about 3 microns to about 10 microns.

11 Claims, 2 Drawing Sheets

LIQUID DEVELOPMENT SYSTEM

Figure 1:
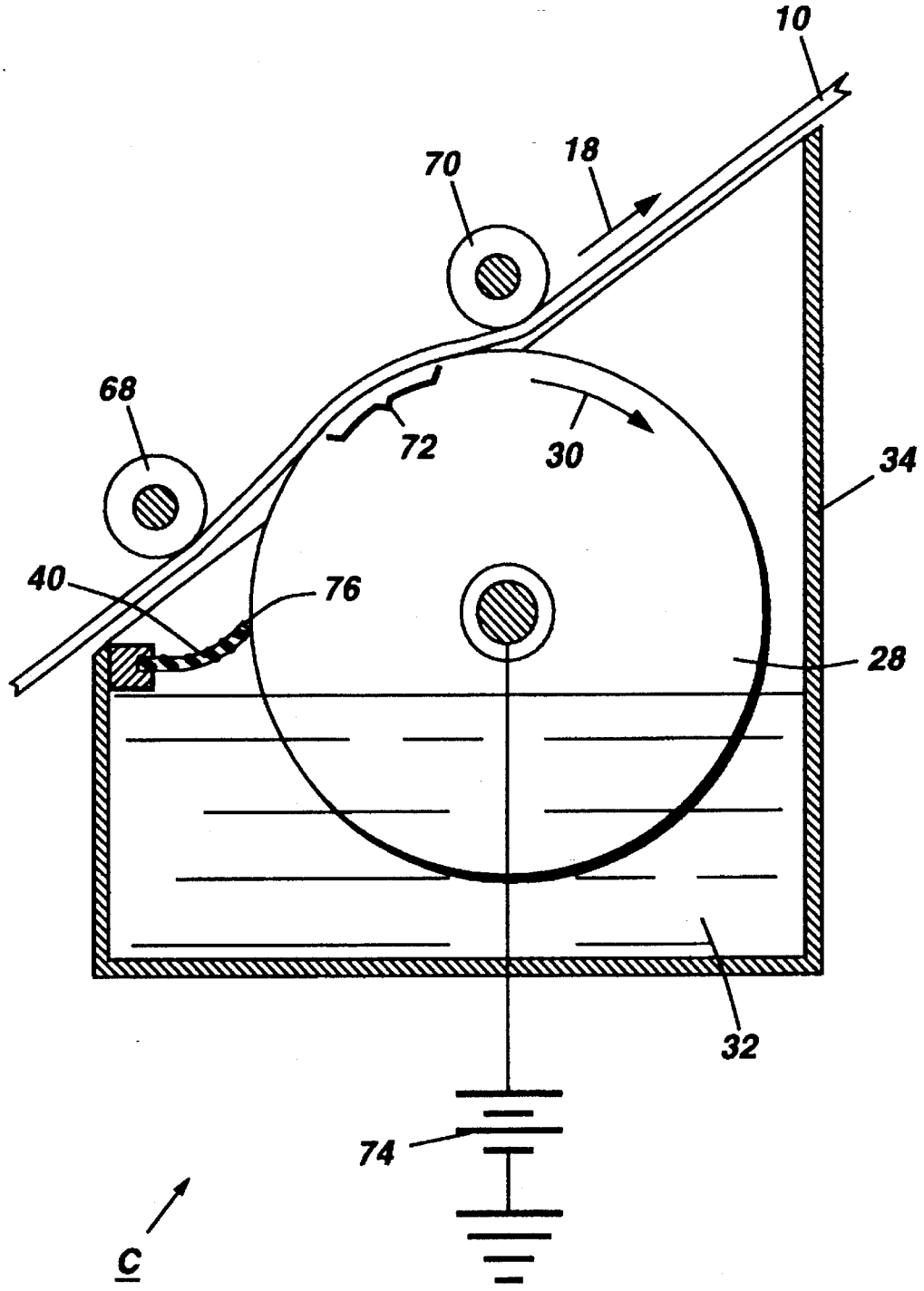

This invention relates generally to a printing machine, and more particularly concerns a development system for developing an electrostatic latent image with a liquid development with a substantially smooth donor roll.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon, in the irradiated areas, to record an electrostatic latent image on the photoconductive member corresponding to the informational areas contained within the original document. After the electrostatic latent image is recorded on the photoconductive member, the latent image is developed by bringing a developer material into contact therewith. Generally, the electrostatic latent image is developed with a dry developer material comprising carrier granules having toner particles adhering triboelectrically thereto. The toner particles are attracted to the latent image forming a visible powder image on the photoconductive surface. After the electrostatic latent image is developed with the toner particles, the toner powder image is transferred to a copy sheet. Thereafter, the toner powder image is heated to permanently fuse it to the copy sheet.

Alternatively, the electrostatic latent image may be developed by furnishing a liquid ink developer material thereto. Various types of liquid ink development systems have heretofore been utilized. An early system embodying such concept is disclosed in U.S. Pat. No. 3,084,043, issued to Gundlach on Apr. 2, 1963. Though specific liquid development systems vary, a typical system includes a gravure roll adapted to receive liquid developer material. Upon receipt of the liquid developer material, a doctor blade is conventionally applied to the gravure roll in an effort to remove excessive fluid which would otherwise interfere with the accurate reproduction of the selected image. The fluid carrying gravure roll is then typically rotated into a position wherein the electrostatic latent image recorded on the photoconductive surface attracts the liquid developer material thereto in image configuration.

In high capacity electrophotographic printing machines, a major consideration in the utilization of a liquid development system is the amount of liquid carrier required to be removed in the subsequent reclamation in order to meet environmental concerns, and to also allow easier transfer and fixing of the image to the substrate. Thus, it is highly desirable to be capable of reducing the amount of liquid developer material deposited on the photoconductive surface so as to reduce the amount of liquid carrier deposited thereon. Preferably, only the marking particles will be deposited on the electrostatic latent image in image configuration. Various types of liquid development systems have heretofore been employed. The following disclosure is to be relevant:

U.S. Pat. No. 4,686,936 Patentee: Chow Issued: Aug. 18, 1987

The relevant portions of the foregoing disclosure may be briefly summarized as follows:

U.S. Pat. No. 4,686,936 discloses a liquid development system wherein a gravure roller applies a liquid developer material to an electrostatic latent image recorded on a photoconductive belt. The photoconductive belt is wrapped about a portion of the exterior circumferential surface of the gravure roller to form an extended development zone. A resilient blade removes excessive liquid developer material from the gravure roller prior to the development zone.

In accordance with one aspect of the features of the present invention, there is provided an apparatus for developing a latent image recorded on a flexible member with a liquid developer material. An open ended housing defines a chamber storing a supply of liquid developer material therein. A donor roll having a substantially smooth exterior circumferential surface, is at least partially immersed in the liquid developer material stored in the chamber of the housing. The donor roll advances liquid developer material to the latent image through the open end of the housing. The flexible member has a portion thereof wrapped about a portion of the exterior circumferential surface of the donor roll so as to form an extended development zone.

Pursuant to another aspect of the features of the present invention, there is provided a printing machine of the type in which a latent image recorded on a flexible member is developed with a liquid developer material. An open ended housing defines a chamber storing a supply of liquid developer material therein. A donor roll having a substantially smooth exterior circumferential surface is at least partially immersed the liquid developer material stored in the chamber of the housing. The donor roll advances the liquid developer material to the latent image through the open end of the housing. The flexible member has a portion thereof wrapped about a portion of the exterior circumferential surface of the donor roll so as to form an extended development zone.

Figure 2:
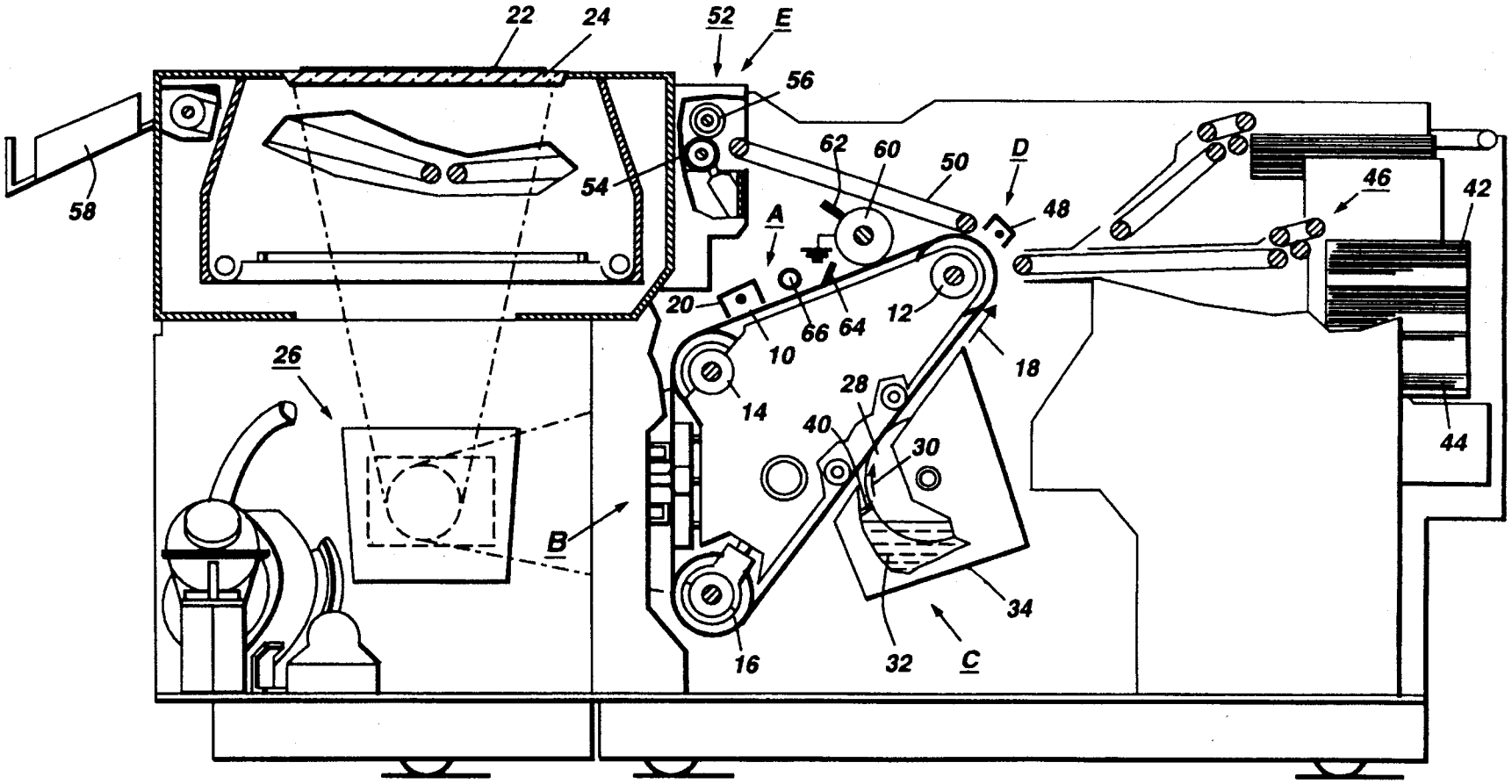

Other aspects of the present invention will become apparent as the following description proceeds and upon reference to the drawings, in which:

FIG. 1 is an elevational view showing the development system used in the FIG. 2 printing machine; and FIG. 2 is a schematic elevational view depicting an electrophotographic printing machine incorporating the features of the present invention therein.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements. FIG. 2 is a schematic elevational view illustrating an electrophotographic printing machine incorporating the features of the present invention therein. It will become apparent from the following discussion that the apparatus of the present invention is equally well suited for use in a wide variety of printing machines and is not necessarily limited in its application to the particular embodiment shown herein.

Turning now to FIG. 2, the printing machine employs a belt 10 having a photoconductive surface deposited on a conductive substrate. Preferably, the photoconductive surface is made from a selenium alloy with the conductive substrate being preferably made from an aluminum alloy which is electrically grounded. One skilled in the art will appreciate that any suitable photoconductive belt, e.g. an organic photoconductive belt, may be used. Belt 10 advances successive portions of the photoconductive surface sequentially through the various processing stations disposed about the path of movement thereof. The support assembly for belt 10 includes three rollers, 12, 14 and 16 located with parallel axes at approximately the apexes of a triangle. Roller 12 is rotatably driven by a suitable motor and drive (not shown) so as to rotate and advance belt 10 in the direction of arrow 18.

Initially, belt 10 passes through charging station A. At charging station A, a corona generating device 20 charges the photoconductive surface of belt 10 to a selectively high, substantially uniform potential.

After the photoconductive surface of belt 10 is charged, the charged portion thereof, is advanced to exposure station B. At exposure station B, an original document 22 is placed upon a transparent support platen 24. An illumination assembly, indicated generally by the reference number 26, illuminates the original document 22 on platen 24 to produce image rays corresponding to the informational areas of the original document. The image rays are projected by means of an optical system onto the charged portion of the photoconductive surface. The light image dissipates the charge in selected areas to record an electrostatic latent image on the photoconductive surface corresponding to the informational areas contained within original document 22.

One skilled in the art will appreciate that in lieu of a light lens exposure system, a raster output scanner (ROS) may be used. The ROS may be regulated by a computer or a raster input scanner (RIS). A typical ROS includes a laser with a rotating polygon mirror and a modulator to lay out the image in a series of horizontal scan lines on the photoconductive belt.

After the electrostatic latent image has been recorded on the photoconductive surface of belt 10, belt 10 advances the electrostatic latent image to development station C. At development station C, a donor roll 28 rotates in the direction of arrow 30 to advance a liquid developer material into contact with the electrostatic latent image recorded on the photoconductive surface of belt 10. The liquid developer material, indicated generally by the reference numeral 32, is stored in the chamber of housing 34. Roll 28 has a substantially smooth exterior circumferential surface which is partially immersed in liquid developer material 32 located in the chamber of housing 34. In order to avoid electrical arcing between the photoconductive surface of belt 10 and donor roll 28, donor roll 28 may be coated with a thin layer of insulating material. The liquid developer material includes an insulating liquid carrier having marking or toner particles dispersed therein. Donor roll 28 is electrically biased to generate an electrical field which causes the liquid developer material be deposited thereon. A metering blade 40 removes the excessive material adhering to roll 28. Development station C will be further described hereinafter with reference to FIG. 1. A portion of belt 10 is wrapped about a portion of the exterior circumferential surface of donor roll 28. An alternate embodiment may use a blade-type ink coater.

With continued reference to FIG. 2, after the latent electrostatic latent image is developed, belt 10 advances the developed image to transfer station D. At transfer station D, a sheet of support material 42 is advanced from stack 44 by a sheet transport mechanism indicated generally by the reference numeral 46. Transfer station D includes a corona generating device 48 which sprays ions onto the backside of the sheet of support material, i.e., copy sheet 42. This attracts the developed image from the photoconductive surface of belt 10 to copy sheet 42. Conveyor belt 50 moves the copy sheet to drying station E.

Drying station E includes a drying assembly, indicated generally by the reference numeral 52, which permanently fixes the developed image to the copy sheet. Drying assembly 52 includes a heated roll 54 and a back-up or pressure roll 56 resiliently urged into engagement therewith to form a nip through which the copy sheet passes. In the drying operation, the liquid carrier is vaporized and the toner particles coalesce with one another and bond to the copy sheet in image configuration. After drying, the finished copy sheet is discharged to output tray 58 for removal therefrom by the machine operator.

After the developed image is transferred to the copy sheet, residual liquid developer material remains adhering to the photoconductive surface of belt 10. A cleaning roller 60, formed of any appropriate synthetic resin, is driven in a direction opposite to the direction of movement of belt 10 to scrub the photoconductive surface clean. To assist in this action, developing liquid may be fed through pipe 62 to the surface of cleaning roller 60. A wiper blade 64 completes the cleaning of the photoconductive surface. Any residual charge left on the photoconductive surface is extinguished by flooding the photoconductive surface with light from lamps 66.

Referring now to FIG. 1, there is shown the detailed structure of development station C. As shown thereat, donor roll 28 is in engagement with belt 10. Guide rolls 68 and 70 confine the path of movement of belt 10. Belt 10 wraps about the exterior circumferential surface of roll 28 to define an extended development zone 72. By way of example, extended development zone 72 may vary from about 1° to about 40°. The extended development zone has been found to improve development of the electrostatic latent image recorded on the photoconductive surface of belt 10. Donor roll 28 has a substantially smooth exterior circumferential surface. Donor roll 28 is electrically biased to a suitable potential and magnitude as to attract the liquid developer material thereto from the chamber of housing 32 and to develop the electrostatic latent image recorded on the photoconductive surface of belt 10, in image configuration, as roll 28 passes through development zone 72. By way of example, the liquid developer material comprises an insulating carrier liquid which may be a hydrocarbon liquid, although other insulating liquids may also be employed. A suitable hydrocarbon liquid is an isopar, which is a trademark of the Exxon Corporation. These are branched, chained aliphatic hydrocarbon liquids (largely decane). The toner particles comprise a binder and a pigment. The pigment may be carbon black. However, one skilled in the art will appreciate that any suitable liquid developer material may be employed. One such suitable developer material is described in U.S. Pat. No. 4,582,774 issued to Landa in 1986, the relevant portions thereof being hereby incorporated into the present application.

As is shown in FIG. 1, donor roll 28 is partially immersed in liquid developer material 32. Voltage source 74 electrically biases donor roll 28 to a suitable potential and magnitude with respect to the electrical bias so that liquid developer material 32 is deposited on roll 28. The liquid developer is transported by roll 28 in the direction of arrow 30. Donor roll 28 then transports the toner particles to metering blade 40. Preferably, metering blade 40 is made from a resilient material, such as an elastomeric material, with the free end portion 76 thereof engaging the exterior circumferential surface of roll 28 so as to control the thickness of the liquid developer material on donor roll 28 to a substantially uniform thickness and to remove excessive liquid carrier material from roll 28. Preferably, the thickness of the layer adhering to donor roll 28 is controlled by metering blade 40 to range from about 3 microns to about 10 microns. Thereafter, donor roll 28 advances the developer material into development zone 72 wherein the electrostatic latent image recorded on the photoconductive surface of belt 10 attracts the toner particles deposited thereto in image configuration. Of course, some liquid carrier is also deposited on the photoconductive surface. Photoconductive belt 10 moves in the direction of arrow 18. Donor roll 28 rotates in the direction of arrow 30. In development zone 72, the tangential velocity of donor roll 28 is in the same direction as that of photoconductive belt 10, as indicated by arrow 18. The tangential velocity of the donor roll in the development zone is substantially the same magnitude as the velocity of photoconductive belt 10.

In recapitulation, it is clear that the development system of the present invention employs a donor roll whose outer circumferential surface is substantially smooth. A resilient blade also controls the thickness of the liquid developer material on the donor roll. A flexible photoconductive belt has a portion thereof wrapped about a portion of the exterior circumferential surface of the donor roll with a layer of liquid developer material interposed therebetween in the development zone. In this way, there is less mechanical shear in the development zone resulting in less image disturbance. This system allows the use of higher concentration inks, e.g. inks having a toner particle concentration ranging from about 5% to about 20%, as compared to inks having a toner particle concentration of about 2%. Furthermore, there is a longer dwell time in the development zone improving the quality of the developed image.

It is, therefore, apparent that there has been provided, in accordance with the present invention a development apparatus which fully satisfies the aims and advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. An apparatus for developing a latent image recorded on a flexible member with a liquid developer material, including: a housing defining a chamber having an open end for storing a supply of the liquid developer material therein; and a donor roll having an exterior circumferential surface, said donor roll being at lease partially immersed in the liquid developer material being stored in the chamber of said housing and advancing the liquid developer material to the latent image through the open end of the chamber of said housing, with the flexible member having a portion thereof wrapped about a portion of the exterior circumferential surface of said donor roll so as to form an extended development zone; and means for adjusting the liquid developer material on said donor roll to a thickness ranging from about 3 microns to about 10 microns.

2. An apparatus according to claim 1, wherein said donor roll includes a layer of insulating material in a circumferential exterior surface thereof.

3. An apparatus according to claim 1, further including means for electrically biasing said donor roll to attract the liquid developer material thereto from the chamber of said housing.

4. An apparatus according to claim 3, wherein the flexible member includes a photoconductive belt.

5. An apparatus for developing a latent image recorded on a photoconductive belt with a liquid developer material, including:

a housing defining a chamber having an open end for storing a supply of the liquid developer material therein;

a donor roll having a substantially smooth exterior circumferential surface, said donor roll being at least partially immersed in the liquid developer material being stored in the chamber of said housing and advancing the liquid developer material to the latent image through the open end of the chamber of said housing, with the photoconductive belt having a portion thereof wrapped about a portion of the exterior circumferential surface of said donor roll so as to form an extended development zone, said donor roll including a layer of insulative material on the exterior circumferential surface thereof; and a resilient blade having a free end portion contacting said donor roll to remove excessive liquid developer material adhering to said donor roll and to regulate the liquid developer material remaining thereon to a thickness ranging from about 3 microns to about 10 microns; and means for electrically biasing said donor roll to attract the liquid developer material thereto from the chamber of said housing.

6. An apparatus according to claim 4, wherein:

said donor roll rotates to have tangential velocity in the development zone having a first direction; and said photoconductive belt has a velocity in the development zone in the first direction with the tangential velocity of a said donor roll and the velocity of said photoconductive belt being substantially equal to one another.

7. A printing machine of the type in which a latent image recorded on a photoconductive belt is developed with a liquid developer material, including:

a housing defining a chamber having an open end for storing a supply of the liquid developer material therein;

a donor roll having an exterior circumferential surface, said donor roll being at least partially immersed in the liquid developer material being stored in the chamber of said housing and advancing the liquid developer material to the latent image through the open end of the chamber of said housing, with the photoconductive belt having a portion thereof wrapped about a portion of the exterior circumferential surface of said donor roll so as to form an extended development zone; and means for adjusting the liquid developer material on said donor roll to a thickness ranging from about 3 microns to about 10 microns.

8. The printing machine of claim 7, wherein said donor roll includes a layer of insulating material on the exterior circumferential surface thereof.

9. The printing machine according to claim 7, further including means for electrically biasing said donor roll to attract liquid developer material thereto from the chamber of said housing.

10. A printing machine of the type in which a latent image recorded on a photoconductive belt is developed with a liquid developer material, including:

a housing defining a chamber having an open end for storing a supply of liquid developer material therein;

a donor roll having a substantially smooth exterior circumferential surface, said donor roll being at least partially immersed in liquid developer material being stored in the chamber of said housing and advancing the liquid developer material to the latent image through the open end of said housing with the photoconductive belt having a portion thereof wrapped about a portion of the exterior circumferential surface of said donor roll so as to form an extended development zone, said donor roll includes a layer of insulating material on the exterior circumferential surface thereof;

a resilient blade having a free end portion contacting said donor roll to remove excessive liquid developer material adhering to said donor roll and to adjust the liquid developer material on said donor roll to a thickness ranging from about 3 microns to about 10 microns; and means for electrically biasing the said donor roll to attract the liquid developer material thereto from the chamber of said housing.

11. The printing machine according to claim 13, wherein:

said donor roll rotates to have tangential velocity in the development zone having a first direction; and said photoconductive belt has a velocity in the development zone in the first direction.

* * * * *